US012214419B2

(12) United States Patent
Hassel et al.

(10) Patent No.: US 12,214,419 B2
(45) Date of Patent: Feb. 4, 2025

(54) METHOD FOR OPERATING A SYSTEM OF THE IRON AND STEEL INDUSTRY

(71) Applicant: SMS group GmbH, Düsseldorf (DE)

(72) Inventors: Christoph Hassel, Düsseldorf (DE); Karl Hoen, Asbach (DE); Cosimo Andreas Cecere, Langenfeld (DE)

(73) Assignee: SMS GROUP GMBH, Düsseldorf (DE)

( * ) Notice: Subject to any disclaimer, the term of this patent is extended or adjusted under 35 U.S.C. 154(b) by 30 days.

(21) Appl. No.: 17/778,162

(22) PCT Filed: Oct. 28, 2020

(86) PCT No.: PCT/EP2020/080233
§ 371 (c)(1),
(2) Date: May 19, 2022

(87) PCT Pub. No.: WO2021/099077
PCT Pub. Date: May 27, 2021

(65) Prior Publication Data

US 2023/0032062 A1 Feb. 2, 2023

(30) Foreign Application Priority Data

Nov. 19, 2019 (DE) ..... 102019217839.1

(51) Int. Cl.
*B22D 11/16* (2006.01)
*B21B 1/46* (2006.01)
(Continued)

(52) U.S. Cl.
CPC ..... *B22D 11/163* (2013.01); *B21B 1/463* (2013.01); *B21B 15/0007* (2013.01); *B22D 11/126* (2013.01)

(58) Field of Classification Search
CPC ..... B21B 1/463; B21B 15/0007; B21B 38/04; B22D 11/126; B22D 11/163
See application file for complete search history.

(56) References Cited

U.S. PATENT DOCUMENTS 5,727,127 A * 3/1998 Schulze Horn ..... B22D 11/16 706/47
2017/0182534 A1* 6/2017 Goto ..... B21B 1/38

FOREIGN PATENT DOCUMENTS

EP 3177412 B1 10/2018
JP H10211512 A 8/1998
(Continued)

OTHER PUBLICATIONS

Machine Translation of Kang (KR 10-2016-0019262 A, cited in IDS filed May 19, 2022, published Feb. 19, 2016). (Year: 2016).*
(Continued)

*Primary Examiner* — Kevin E Yoon
*Assistant Examiner* — Jacky Yuen
(74) *Attorney, Agent, or Firm* — Maier & Maier, PLLC

(57) ABSTRACT

A method for operating a system of the iron and steel industry for producing a metal product with participation of a severing or forming device. The actual value of an indicator be calculated over a length section of the metal product for the metal product to be produced. The indicator represents the resistance of the metal product to severing or forming processes. The calculated actual value $p_{Ist}$ for the indicator p is then compared to a predefined threshold value. The severing or forming also only actually takes place when the actual value of the indicator of the metal product is less than the threshold value. If a comparison should show that the actual value of the indicator is greater than the threshold
(Continued)

value, before the severing or forming of the metal product, a local processing of the metal product is performed in the corresponding length section.

10 Claims, 2 Drawing Sheets

(51) Int. Cl.
*B21B 15/00* (2006.01)
*B22D 11/126* (2006.01)

(56) References Cited

FOREIGN PATENT DOCUMENTS

| | | | |
|---|---|---|---|
| KR | 1020160019262 | A | 2/2016 |
| WO | 99/24182 | A1 | 5/1999 |

OTHER PUBLICATIONS

International Search Report (with English translation) and Written Opinion (with Machine translation) issued on Dec. 22, 2020 in corresponding International Application No. PCT/EP2020/080233; 16 pages.
Office Action issued on Feb. 1, 2023, in corresponding Japanese Application No. 2022-528259, 6 pages.

* cited by examiner

METHOD FOR OPERATING A SYSTEM OF THE IRON AND STEEL INDUSTRY

FIELD

The invention relates to a method for operating a system of the iron and steel industry, in particular a casting and/or rolling system for producing a metal product with participation of a severing device or a forming device.

BACKGROUND

FIG. 3 shows an example of such a system of the iron and steel industry, as is known in principle in the prior art. FIG. 3 specifically shows a combined casting and rolling system. The casting system is identified by the reference sign 1. It consists of a die arranged at the entry and a strand guide arranged after the die in the strand casting direction for deflecting a casting strand cast in the die from the vertical into the horizontal. The material flow direction is from left to right in FIG. 3. In the material flow direction, a first severing device, in particular shears 2, adjoins the strand guide, which marks the transition between the casting system and the rolling system. The rolling system comprises, viewed in the material flow direction, for example, two roughing stands 3, a transfer bar cooler 4, a furnace 5, an inductive heater 6, a plurality of finishing stands 7, a cooling line 8, a second severing device, in particular shears 9, and a forming device, in particular a coiling device 10. The mentioned subassemblies of the casting system and the rolling system are partially optional and in no way always all have to be implemented in a specific system. All subassemblies are subject to a central process control and material tracking 11.

The system shown in FIG. 3 is a typical continuous slab production (CSP) system, which can be run in particular in a batch operating mode. However, the present invention is in no way restricted thereto. Rather, the present invention can also be used in arbitrary systems of the mentioned type, in particular also those which, in addition to the batch mode, can also be operated in a so-called endless mode and/or a so-called semi-endless mode.

Systems of the iron and steel industry having permanently installed severing or forming devices can sometimes no longer cut or form new metal products to be produced, because these products are too strong or because their resistance to severing or forming is too high. The performance of the permanently installed severing or forming devices is then no longer sufficient in this case. So as not to have to restrict the functionality of the overall system in such a case due to the performance limitation, in particular of a severing device, but rather be able to maintain it, deliberately weakening the metal product to be produced in a predefined length section, in which the metal product is to be cut with the aid of the severing device, is known in the prior art. European patent specification EP 3 177 412 B1 suggests for this purpose that the temperature of the metal strip be deliberately increased in this length section and the strength of the metal product thus be reduced in this section enough that cutting of the metal product using the existing performance-limited severing device is possible.

The overall quality or quality desired in the production of the metal product is advantageously not negatively affected by this measure, because said temperature increase only relates to a very narrowly limited length section, in which severing of the metal product is provided in any case.

SUMMARY

The invention is based on the object of providing an alternative method for operating a system of the iron and steel industry in which severing or forming a metal product is carried out by a severing or forming device having limited performance.

This object is achieved by the method characterized by the following steps:

a) predefining a threshold value characteristic for the performance of the severing or forming device;

b) calculating an actual value for an indicator of the metal product in the length section, wherein the indicator represents the resistance of the metal product to severing or forming processes;

c) comparing the calculated actual value of the indicator to the predefined threshold value as to whether the actual value of the indicator is greater than the threshold value;

d1) if yes: locally processing the metal product in said length section in such a way that the value of the indicator sinks below the threshold value, and severing or forming the metal product in said length section only when the actual value of the indicator is less than the threshold value;

d2) if no: severing or forming the metal product in said length section without the prior local processing.

The term "or" used in conjunction with the severing or forming device or with the verbs "severing/forming" is not to be understood as an excluding "or", but rather in the meaning of and/or. The claimed method offers the advantage that it is first checked whether the performance of severing or forming devices present in the system is sufficient for severing or forming the metal product to be produced. Only when this is not the case, because the threshold value which represents the performance is less than the actual value of the indicator which represents the resistance of the metal product in the length section, does suitable processing takes place, i.e., weakening of the metal product in the previously defined length section. If a sufficient performance of the severing or forming device should be established, in contrast, the targeted processing or weakening of the metal product in the length section is omitted and the costs linked thereto are saved. Any physical or metallurgical property of the metal product can be used as the indicator for carrying out the method according to the invention, if this indicator at least to some extent only represents the resistance of the metal product to severing or forming processes. The indicator can involve individual parameters, e.g., the thickness, the width, the temperature, or the strength of the material of the metal product, but also a functional linkage of such individual parameters. The processing step for targeted weakening of the metal product in the length section is accordingly not restricted to a single measure. Depending on the indicator and material of the metal product and other process conditions, a single one or multiple processing steps can be selected from a bundle of individual processing steps to deliberately weaken the metal product locally and thus also to be able to produce the metal product in a system of the iron and steel industry having permanently installed severing or forming devices having limited performance.

According to a first exemplary embodiment, the following functional relationship is used as the indicator p:

$$p=f(w,d,T,k_f) \quad (1)$$

wherein:

d denotes the thickness of the metal product, in particular in the length section w denotes the width of the metal product, in particular in the length section T denotes the temperature of the metal product, in particular in the length section $k_f$ denotes the strength of the metal product, in particular in the length section f denotes the functional linkage between the mentioned parameters w, d, T, and/or $k_f$; and wherein the linkage is designed in such a way that its functional value, which corresponds to the actual value $p_{Ist}$ of the indicator, increases if the thickness, the width, and/or the strength of the metal product increases and/or its functional value decreases if the temperature of the metal product increases.

In this functional relationship f, individual ones of the mentioned parameters d, w, T, $k_f$ can also be set to zero or be omitted.

In a specific embodiment of formula (1), indicator p can be calculated as follows, for example:

$$p = \frac{d \cdot w}{T} \cdot k_f \cdot c \tag{2}$$

Alternatively, indicator p can also be calculated as a special case of formula (1) as follows, for example:

$$p = d \cdot w \cdot k_f \cdot c \tag{3}$$

The temperature is disregarded in formula (3).

In all three formulas (1), (2), and (3), parameters d, w, T, $k_f$ have the same meaning indicated above.

Parameter c denotes an arbitrary constant where $c \in \mathbb{R}$.

If it should turn out according to method step d1) that the actual value of the indicator for the metal product after completed processing is not yet less than the threshold value in the predefined length section, the present invention thus provides that steps b), c), and d1) or d2) are iteratively repeated until the actual value of the indicator is less than the threshold value, to then be able to carry out the desired severing or forming process using the existing performance-limited severing or forming device.

Further advantageous embodiments of the method according to the invention are the subject matter of the dependent claims.

BRIEF DESCRIPTION OF THE FIGURES

The following figures are appended to the description, wherein.

DETAILED DESCRIPTION

Figure 1:
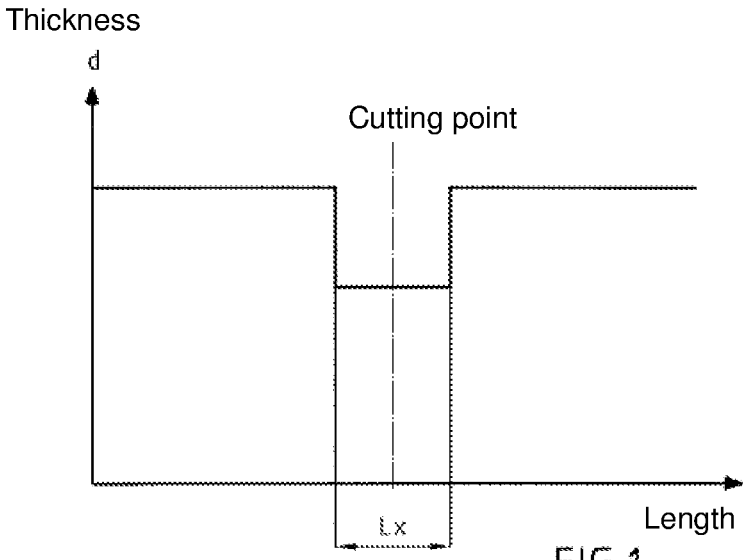
FIG. 1 shows a first exemplary embodiment for the claimed processing step in a predefined length section of the metal product, a thickness reduction here, for example.

The invention is described in more detail hereinafter with reference to mentioned FIGS. 1 and 2 in the form of exemplary embodiments. In all figures, identical technical elements are identified with identical reference signs.

The cutting force of a severing device and the forming capability of a forming device, in particular the winding capability of a coiler, are always restricted. The performance required of the coiler is particularly high for winding on a first turn. To be able to utilize the severing device and/or forming device present in a system of the iron and steel industry each having limited performance in the best possible manner and not to have to exclude the production of thicker, wider, or high-strength metal products, it is provided according to the invention that the load for the severing device or the forming device is reduced in those length sections in which the metal product is later to be severed, i.e., cut, or formed during the passage through the system.

Said length section can in principle be predefined at any point over the length of the metal strip. It can thus be defined, for example, at the cutting point of the severing device, thus at the transition of a strip end to the next strip beginning or in the case of forming by a coiler at the strip head of a metal product; in the latter case to facilitate the winding of in particular the first turn of the strip head onto the coiler. In general, the load for the severing device and the forming device increases with increasing thickness, with increasing width, and with increasing strength of the material of the metal product. Vice versa, the load decreases with increasing temperature, since then the strength or the yield stress of the material becomes less. Furthermore, the load is dependent on the material. A softer material having lower $k_f$ is easier to cut or wind than a more solid material. The term "load" means the resistance of the metal product to severing or forming processes. In consideration of the mentioned plurality of individual parameters which influence the resistance, it appears expedient to define an indicator p for a metal product which, as stated, represents the resistance of the metal product to severing or forming processes. The present invention recommends calculating this indicator according to an exemplary embodiment for above-mentioned formula (1) as follows as actual value $p_{ist}$:

$$p_{Ist} = \frac{d \cdot w}{T} \cdot k_f \cdot c \tag{2}$$

In this case, d denotes the thickness of the metal product, w denotes the width of the metal product, T denotes the temperature of the metal product, and $k_f$ denotes a material indicator of the metal product which represented strength. Parameter c denotes an arbitrary constant.

According to an alternative exemplary embodiment, indicator p can also be calculated as follows as an actual value:

$$p_{Ist} = d \cdot w \cdot k_f \cdot c \tag{3}$$

In this alternative definition, the temperature of the metal product is disregarded.

An actual value for the indicator in the length section can be calculated on the basis of the mentioned formulas for each metal product to be produced on the system.

For at least individual, preferably for all severing or forming devices present in the system, according to the invention, a threshold value is defined in each case, which characterizes the performance of the individual severing or forming devices with regard to their severing or forming force.

The method according to the invention then provides that the actual value of the indicator calculated for the metal product to be produced is compared to the predefined threshold value for the performance of the individual devices as to whether the actual value is greater than the threshold value; see method step c). That is to say, it is checked whether the resistance of the metal product is greater than the performance of the individual device, in particular the device having the lowest performance. If this is the case, the metal product is deliberately weakened in said length section during the passage through the system before reaching the corresponding severing or forming device, with the goal that the actual value of the indicator sinks below the threshold value.

Only when this target is reached can the provided severing or forming of the metal product be carried out in said length section with the aid of the severing or forming device provided in the system. As long as the actual value of the indicator is not yet below the threshold value the metal product to be produced cannot be correctly processed by the severing or forming device. If the actual value of the indicator has not yet decreased below the threshold value after carrying out a first processing step of the metal product, a repetition of in particular claimed method steps b), c), and d1) or d2) is recommended until the actual value of the indicator has decreased below the threshold value. Only then can the metal product be processed by the provided severing or forming device.

In the processing, i.e., the targeted weakening of the metal product, it is to be noted that it is undesirable in principle, since it contradicts the desired material properties of the metal product to be produced. Therefore, it has to be ensured by the automation of the system that the processing or weakening of the metal product is exclusively restricted to the previously defined length section and therefore only takes place where the severing device is to cut the metal product or where the forming device is to form the metal product. For this purpose, it is necessary that it is already defined beforehand, in particular already during the casting, at which points severing or a cut or forming is later to take place. This position or the corresponding length section Lx of the metal product, which is typically defined beforehand by the automation of the system, is tracked as the metal strip is guided through the system at least until reaching the severing device or the forming device. The severing or forming of the metal product is then carried out by said severing or forming device exclusively in the predetermined length section.

Figure 2:
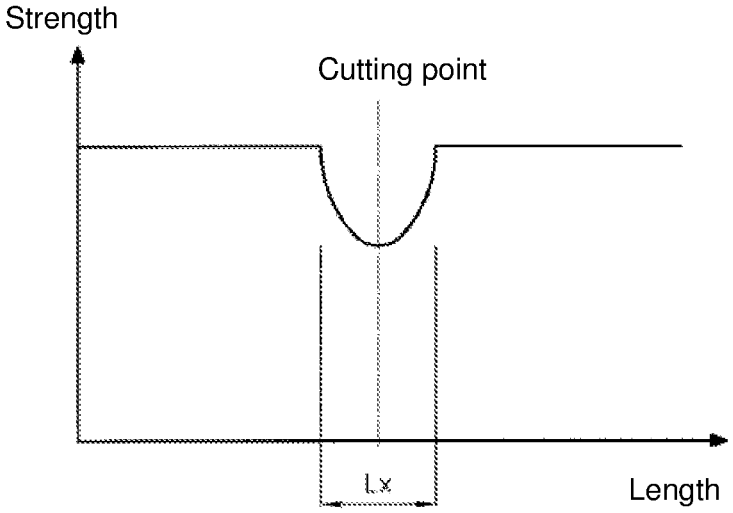
FIG. 2 shows a second exemplary embodiment for the claimed processing step over the length section: here a reduction of the strength of the metal product, for example.
Figure 3:
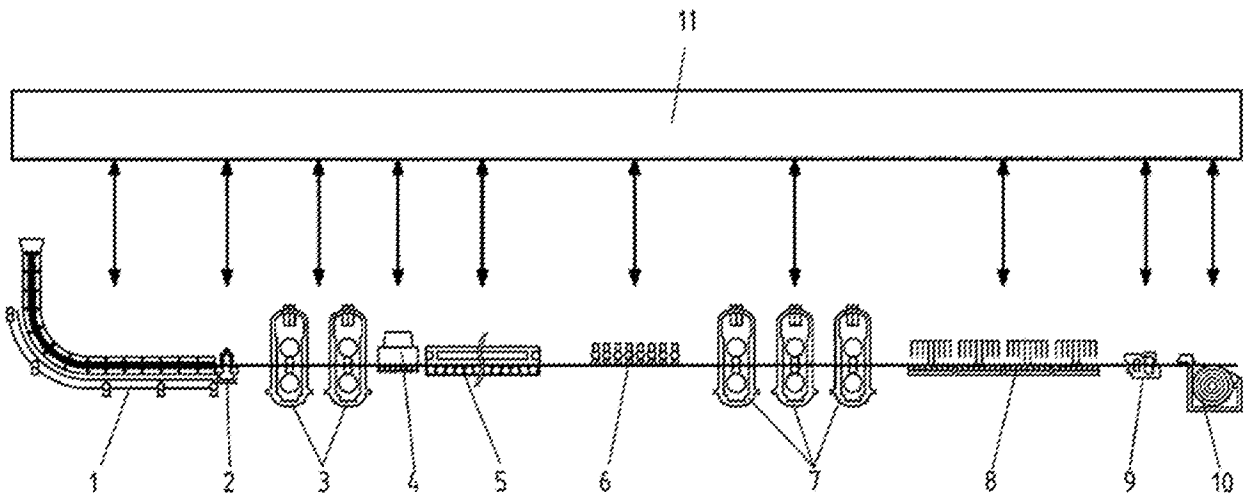
FIG.3 Prior art
FIG. 3 shows a casting and rolling system from the prior art.

The processing or weakening according to the invention of the metal product in the length regions Lx for reducing the local actual value there of the indicator can be carried out by at least one of the following individual steps:

i) Reducing the thickness d of the metal product by way of one or more rolling stands which induce a lesser thickness over the length section Lx due to a stronger decrease of the metal product; see FIG. 1. This process has the particular advantage that the amount of material in the length section Lx can be reduced.

ii) Reducing the width w of the metal product with the aid of a sizing unit or by variation of the width of the casting strand in the die; this also has the advantage that the material is reduced or decreased in the length section, i.e., in the transition region, for example, in steps.

iii) Increasing the temperature of the metal product, for example by an inductive heater or by a transfer bar cooler or by carrying out a suitable cooling strategy in the secondary cooling of the casting system or the cooling line of the rolling system, wherein the strategy provides a reduction of the cooling power over the length section in each case.

iv) Reducing the strength of the metal product over the length section, see FIG. 2, for example, also by carrying out a suitable cooling strategy. It is thus possible, for example, to set a reduced strength having, for example, parabolic profile over the length section by way of a first late cooling instead of an early cooling or by way of a slow cooling instead of a fast cooling and thus to decrease the actual value of the indicator in this length section. This can also be achieved by the coiler temperature.

Furthermore, a lower target strength or a reduced value for indicator $k_f$ in the length section can be set by a microstructure model, in that the process variables are suitably predefined for this purpose. The process variables can be, for example, the furnace, final rolling, or coiler temperature or the dwell times of in particular the length section of the metal product in the furnace or a finishing rolling line. The process variables of the microstructure model to be predefined can also be the above-mentioned parameters such as the thickness, the width, or the strength or the temperature of the metal product. Additionally, however, the properties can also be influenced by a change of the reduction distribution in the stands.

A higher-order model—based on algorithms or artificial intelligence algorithms, such as neural networks or others—can be installed which then decides whether the thickness, the temperature, the width, or the material indicator $k_f$ or a plurality of these values are to be changed to decrease the actual value of the indicator below the threshold value. Furthermore, this model can decide which assembly, i.e., which severing or forming device of the system is to take over the variation of the selected parameters. In cases of problems or malfunctions at individual ones of the severing or forming devices, replanning can also be carried out in running operation according to the invention. This can mean, for example, that instead of an initially planned thickness reduction of the metal product, due to a malfunction of the rolling stand provided for the thickness production, a reduction of the width and/or an increase of the temperature is carried out over the length section of the metal product to reduce the actual value of the indicator below the threshold value. The deciding variable in the replanning can be that a best possible quality is achieved or that as little energy as possible is consumed or that the product remains as stable and safe as possible.

LIST OF REFERENCE SIGNS

1 casting device
2 severing device, in particular shears
3 roughing stand(s)
4 transfer bar cooler
5 furnace
6 inductive heater
7 finishing stand(s)
8 cooling line
9 severing device, in particular shears
10 forming device, in particular coiler
11 process control, material tracking
Lx length section
p indicator
d thickness of the metal product

The invention claimed is:

1. A method comprising:

defining a length section (Lx) of a metal product;

guiding a metal strip through a combined casting and rolling system; and tracking the defined length section of the metal product during its guidance through the combined casting and rolling system;

predefining a threshold value for the performance of a severing or forming device;

calculating, with a neural network, an actual value $p_{Ist}$ for an indicator p of the metal product in the defined length section, wherein the indicator p represents resistance of the metal product to severing or forming processes;

deciding, with the neural network, whether a severing device or a forming device of the combined casting and rolling system varies parameters in calculating the actual value $p_{Ist}$ for the indicator p;

comparing the calculated actual value $p_{Ist}$ of the indicator p to the predefined threshold value for the indicator p; and severing or forming the metal product in the defined length section only when the actual value $p_{Ist}$ of the indicator p is less than the threshold value.

2. The method as claimed in claim 1, wherein the actual value $p_{Ist}$ for indicator p is calculated according to:

$$P_{Ist}=f(w,d,T,k_f)$$

wherein d denotes a thickness of the metal product in the defined length section, w denotes a width of the metal product in the defined length section, T denotes a temperature of the metal product in the defined length section, $k_f$ denotes a strength of the metal product in the defined length section, f denotes a functional linkage between w, d, T, and $k_f$, the actual value $p_{Ist}$ of the indicator increases in proportion to the thickness, the width, and the strength of the metal product, and the actual value $p_{Ist}$ decreases in proportion to the temperature of the metal product.

3. The method as claimed in claim 2, further comprising: reducing the thickness d of the metal product in the defined length section.

4. The method as claimed in claim 3, wherein measures for processing the metal product are changed based upon changed operating conditions during running operation of the combined casting and rolling system.

5. The method as claimed in claim 2, further comprising: reducing the width w of the metal product in the defined length section.

6. The method as claimed in claim 2, further comprising: increasing the temperature T of the metal product in the defined length section.

7. The method as claimed in claim 2, further comprising: reducing the strength $k_f$ of the metal product in the defined length section.

8. The method as claimed in claim 7, wherein the reduction of the strength $k_f$ is carried out by cooling the metal product using a suitable cooling strategy in a cooling device of the combined casting and rolling system.

9. The method as claimed in claim 7, wherein the reduction of the strength $k_f$ is carried out by a suitable variation of process variables by a microstructure model.

10. The method as claimed in claim 7, wherein reduction of the strength $k_f$ has a parabolic profile over the defined length section.

* * * * *